United States Patent [19]

Young, Jr. et al.

[11] Patent Number: 4,951,894

[45] Date of Patent: Aug. 28, 1990

[54] METHOD AND APPARATUS FOR HANDLING ROLLS OF TEXTILE FABRICS AND OTHER WEBS

[75] Inventors: William O. Young, Jr., Spartanburg; Ebun Surka, Moore, both of S.C.

[73] Assignee: Young Engineering, Inc., Spartanburg, S.C.

[21] Appl. No.: 258,371

[22] Filed: Oct. 17, 1988

[51] Int. Cl.[5] ..... B65H 19/12

[52] U.S. Cl. ..... 242/58.6; 242/68.4

[58] Field of Search ..... 242/58.6, 79, 68.4, 242/58.1–58.5, 81, 55

[56] References Cited

U.S. PATENT DOCUMENTS

| | | | |
|---|---|---|---|
| 2,095,019 | 10/1937 | Wood | 242/68.4 |
| 3,329,369 | 7/1967 | Guthrie | 242/58.6 |
| 3,669,372 | 6/1972 | De Jong | 242/58.6 X |
| 3,695,542 | 10/1972 | Briggs | 242/68.4 X |
| 4,209,140 | 6/1980 | Seibert | 242/58.6 X |
| 4,443,291 | 4/1984 | Reed | 242/58.2 X |
| 4,693,433 | 9/1987 | Martin | 242/58.6 |
| 4,706,905 | 11/1987 | Torres | 242/68.4 |
| 4,715,553 | 12/1987 | Hatakeyama et al. | 242/68.4 |
| 4,767,076 | 8/1988 | Tagawa | 242/58.6 |

*Primary Examiner*—John M. Jillions

*Attorney, Agent, or Firm*—Dority & Manning

[57] ABSTRACT

Apparatus for handling rolls of web goods such as fabric, preparatory to the unwinding of same. A carriage is movable vertically about a support frame between a first position where a roll of web goods is stored and a second upper position where the roll of web goods will be unwound. The carriage includes two independently driven arm assemblies, each of which has a chuck for holding engagement with the core of the roll of web goods. With the carriage in the upper position, once a roll of web goods is fully unwound leaving the bare core chucked between the movable arms, a core receiver is placed beneath the core, after which the core is unchucked and automatically stripped from the arms, whereby it is caught by the core receiver. The core receiver then moves out of the way and the carriage descending about a new roll of web goods. When the chucks are properly vertically aligned with the core of the new roll, the arms are driven inwardly to position the chucks within opposite ends of the core. The chucks are then brought into a holding engagement with the core and the carriage is moved upwardly to the second position where the new roll of web goods can then be unwound, while a further new roll of web goods is located at the first roll position. With the exception of locating a new roll of web goods at the first roll position, preparation of the lead end of the new web for joining with the prior web, and removal of cores from the core receiver, the apparatus preferably operates automatically by a program controller or the like. The method performed is also disclosed and claimed.

21 Claims, 4 Drawing Sheets

METHOD AND APPARATUS FOR HANDLING ROLLS OF TEXTILE FABRICS AND OTHER WEBS

BACKGROUND OF THE INVENTION

The present invention relates to apparatus and method for the handling of roll goods, such as rolls of fabric or other webs, preparatory to the goods being unwound for further processing.

Many processes for the treatment and/or handling of webs such as fabric, films and the like, utilize the goods in roll form. Such is occasioned by the fact that the particular process or system for handling the web goods is therefore not dependent on another process, the speed of which may be greater or lesser than that of the process of concern. Moreover, particularly in the handling of textile fabrics, many different processes are involved between the formation of the fabric and the final treatment of same for its intended use. Such different and diverse processes often require movement of the goods from different locations within a plant to a further location or even between different plants. In such processes, such as the production of larger rolls of goods from small rolls, continuous in-line application of various finishes and dyestuffs to the web, tentering of the web to stabilize same, and the like, the fabric or web is fed through same and taken up in roll fashion at the exit end. Upon depletion of a roll of goods, the trailing end of a first, depleted roll is joined to the leading end of a subsequent roll to avoid rethreading of the new roll of goods to the process, and/or to avoid machine downtime.

Many techniques have heretofore been developed for joining a new roll of goods to one presently passing through a process which involves seaming or otherwise connecting the webs. Exemplary of such processes for joining two web ends are commonly assigned U.S. Pat. No. 4,700,642 and pending application Ser. No. 107,176 now U.S. Pat. No. 4,829,918 filed Oct. 13, 1987 in the name of William O. Young, Jr., the subject matter of which are incorporated herein by reference.

Many of the prior processes for joining two ends of a web for the further processing of same likewise include a provision for storage and/or preparation of a new roll of web goods to be available for joining to the trailing end of the prior roll as quickly and as conveniently as possible to minimize machine downtime which, if extended, may lead to alteration of process conditions to avoid damage to lengths of material then being processed.

The present invention is not concerned with any particular process for treating or handling the web goods, but instead is directed to a convenient and efficient method and apparatus for handling of the roll goods at the introduction to the process. There is no known prior art that is believed to teach or suggest the apparatus or process of the present invention.

SUMMARY OF THE INVENTION

It is an object of the present invention to provide improved apparatus for the handling of roll goods in preparation for the unwinding of same.

Another object of the present invention is to provide improved apparatus for automatically preparing a roll of web material for introduction to a downstream process for treating or handling same.

Still another object of the present invention is to provide an improved process for the handling of a roll of web goods preparatory to introduction of same to a downstream process.

Yet another object of the present invention is to provide an an improved method for handling a roll of web goods during the unwinding of same and upon exhaustion of said web providing a further roll of web goods for introduction to said process.

Generally speaking, the present invention relates to apparatus for handling rolls of web goods for the subsequent unwinding of same comprising a support frame; a carriage received on said support frame for vertical movement between first and second roll positions, said carriage having a pair of movable support arms received thereon, each of said support arms having chuck means thereon; drive means for said carriage for moving said carriage between said first and said second roll positions; means for locating said carriage with respect to a roll of web goods in said first roll position to vertically align said chuck means with respect to a hollow core about which said roll has been formed; drive means operatively associated with said movable arms for moving said arms toward and away from each other; and means for sensing the relative position of said chuck means and said core and for actuating said chuck means to produce positive chucking engagement with said core, whereby after said roll of web goods is properly chucked said carriage drive means may be actuated to move said carriage and said roll of web goods to said second position for unwinding, and a second roll of web goods may be located at said first roll position.

More specifically, apparatus of the present invention may be conveniently located at the head end of a process for the handling or treating of a web. A support frame is provided which could, of course, be a part of the support frame of the downstream apparatus, and which has a carriage mounted thereon and movable in a vertical plane up and down the support means, preferably being driven by a chain drive. The carriage includes preferably a pair of stationary arms that extend outwardly in a direction away from the downstream process with the pair of movable arms located therebetween and having independent drive means for moving the arms in and out toward and away from each other. Each of the arm means includes roll chuck means which are preferably of the inflatable type. Likewise, in a most preferred embodiment the carriage has associated therewith core receiving means for receiving and removing an empty core once a roll has been unwound.

The first roll position is provided adjacent a lower end of the support and preferably includes structure defining a cradle for receipt of a roll of web goods thereat. The leading end of the web of the new roll can then be prepared for joining to the trailing end of a prior web if appropriate. Means may also be provided adjacent the first roll position or on the carriage to properly vertically orient the carriage with respect to a roll located in the first roll position. Once the chuck means and the roll core are properly located, the movable arms of the carriage are moved inwardly where the chuck means are received by the roll core. Means are provided for determining when the chuck means are properly received within the core. When the chuck means are properly within the core, the chuck means are manipulated to move into proper holding engagement with the core. Thereafter, the carriage is moved upwardly taking the roll from the first position to the second position where the web from the roll can be unwound and subjected to the particular process, though it should be understood that unwinding of the web can commence as soon as the roll leaves the cradle at the first roll position.

While the first roll of goods is in the run or second position, the first roll position is empty and a second, new roll of goods may be placed thereat and appropriately prepared for subsequent handling by the apparatus.

In a most preferred embodiment, a clutch means is provided which is engaged when the two movable arms have properly chucked opposite ends of the roll core to then permit the two arms to move in unison between the stationary arms for centering of the roll of goods if necessary.

Likewise, in a most preferred embodiment, apparatus according to the present invention further includes core stripper means on one or both arm assemblies to automatically remove the core after unwinding of the web therefrom and a core receiving means to receive and hold the empty core away from the operative zone of the apparatus for later disposition as desired.

Generally speaking, the method according to the present invention comprises the steps of locating a roll of web material at a first roll position; locating a movable carriage having roll support arms with roll chuck means adjacent said roll in said first position; moving said support arms into contact with a core about which said roll of web material has been produced; bringing said chuck means into holding engagement with said core; moving said carriage and said roll carriage thereon upwardly to a second roll position from which said web material may be fed to a web handling process.

More specifically, in the method according to the present invention with a roll of web material received at a first roll position, the carriage having the roll support arms received thereon is moved downwardly along its vertical path until it is located in a proper position with respect to said roll for permitting the chuck means on said arms to move within the interior of the core. When the chuck means are properly within the core, the chuck means are actuated, preferably being inflated, into holding engagement with the core. Thereafter, the carriage and the chuck roll are moved vertically upwardly to a second roll position from which the web material will be unwound from the core while controlling the lateral position of the roll to maintain same in a central position, though unwinding can begin upon leaving the first roll position. After depletion of the web material from the core, the core is removed by deflating one of said chuck means only and retracting said arm to remove said defated chuck means from within said core, while said opposite arm which is still chucked to the core is moved rearwardly with respect to its chucking position. Thereafter, the second chuck is deflated and the stripper means forces the empty core away therefrom which permits the empty core to fall into a core receiving element position appropriately to receive same. The core receiving element with the empty core therein can then be moved out of the operative position of the apparatus for ultimate manual removal and disposition. Alternatively, both arms may have stripper means. In such embodiment, both chucks are deflated and both arms move outwardly with the stripper means holding the core until the arms move out adequately for the core to fall therefrom and into the receiver.

In a most preferred embodiment, apparatus according to the present invention is automatically operated by a programmable controller.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

FIG. *7a* and *7b* are partial elevational views of a chuck means for use with one of the movable arms of apparatus according to the present invention illustrating a preferred embodiment for core stripping.

DESCRIPTION OF THE PREFERRED EMBODIMENTS

Making reference to the figures, preferred embodiments of the present invention will now be described in detail.

Figure 1:
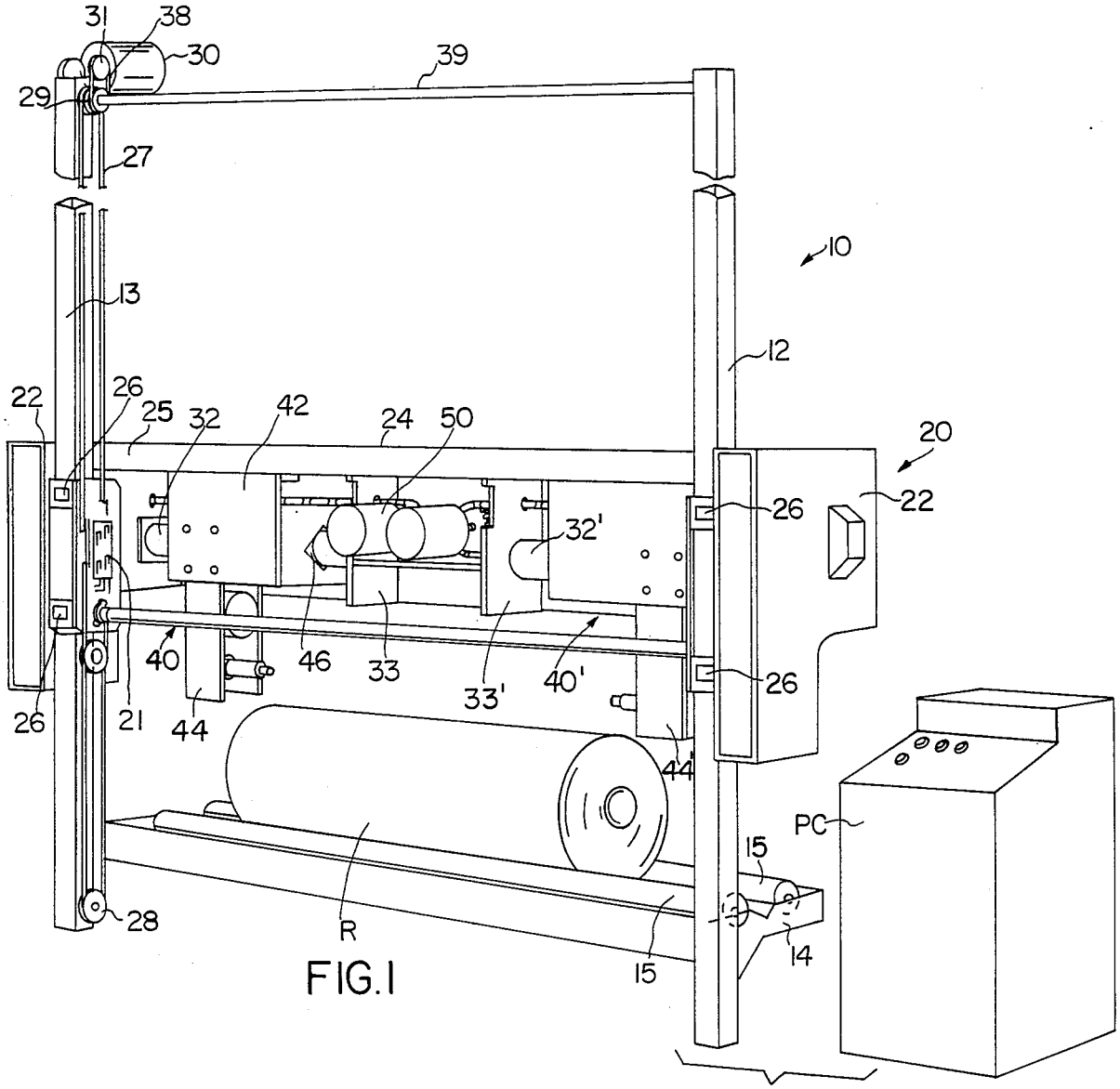
FIG. 1 is a perspective view of apparatus according to teachings of the present invention.

Making particular reference to FIG. 1, apparatus according to the present invention is illustrated which includes a support frame generally indicated as 10, with vertical columns 12 and 13 forming a part of same. In practice, as is partially shown in phantom in FIG. 3, apparatus according to the present invention could be tied in to further processing apparatus exemplified by automatic sewing apparatus which is utilized to connect a trailing end of a web from a depleted roll of web goods to a leading end of web goods that is in roll form being supported by the apparatus of the present invention. Such automatic sewing apparatus is illustrated in commonly assigned application Ser. No. 107,176, filed Oct. 13, 1987 in the name of W. O. Young, Jr. and entitled "Replenishing Apparatus for Web Processing Machines", now U.S. Pat. No. 4,829,918 all of which is incorporated herein by reference.

Figure 2:
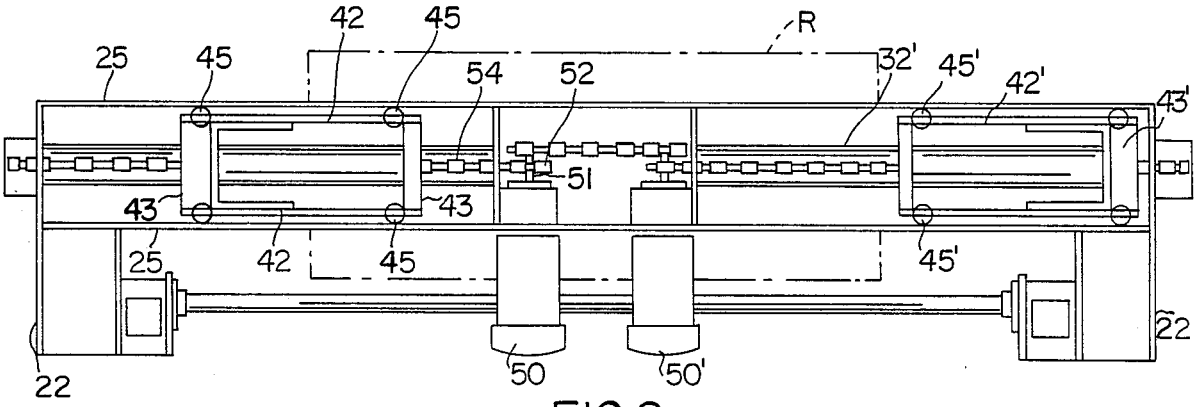
FIG. 2 is a top plan view of the apparatus as shown in FIG. 1 cut away for clarity.
Figure 3:
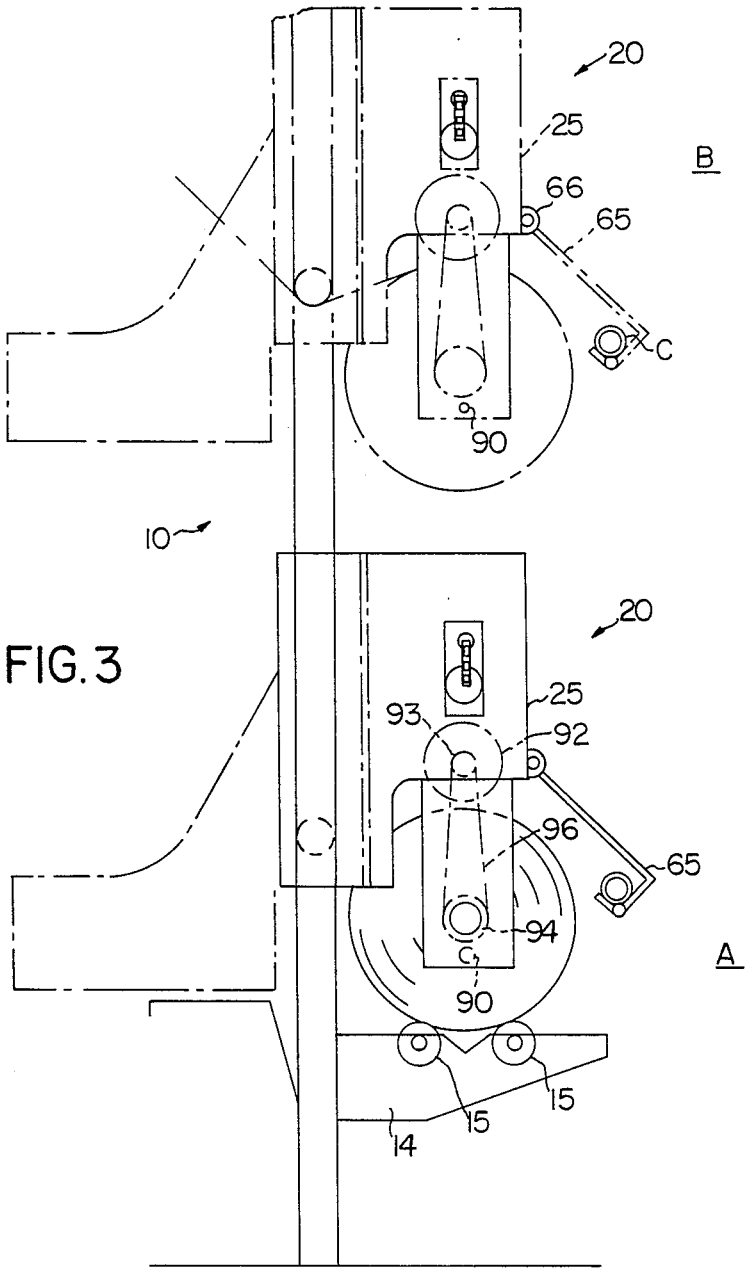
FIG. 3 is a side elevational view of the apparatus as shown in FIG. 1.
Figure 6:
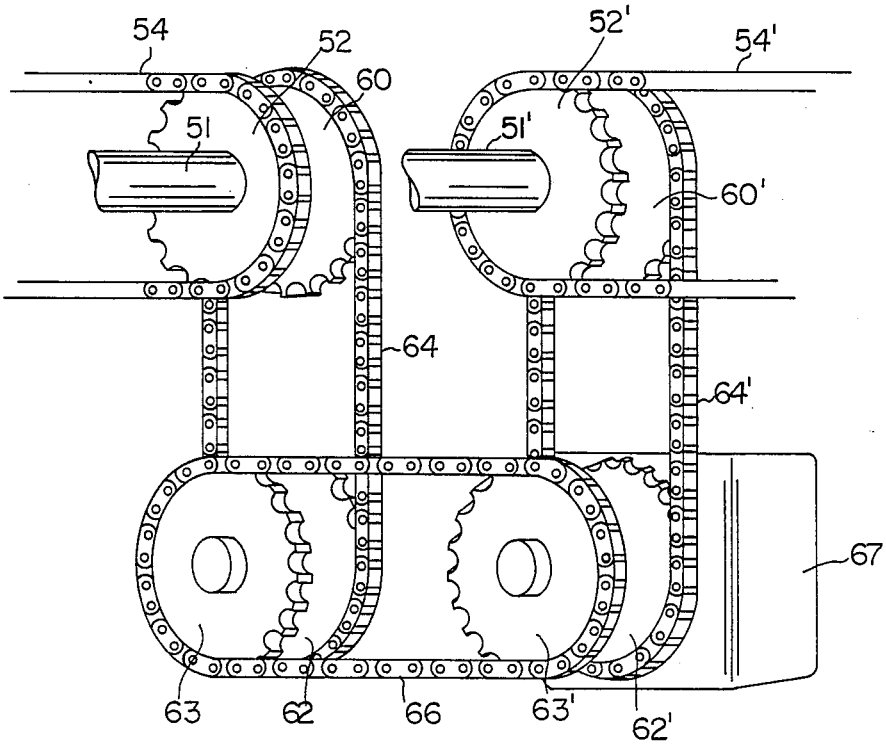
FIG. 6 is a partial view in perspective of apparatus according to the present invention illustrating interconnection between drive means for the movable arms.

Located on support frame 10 is a carriage generally indicated as 20 which is adapted for driven movement up and down support frame 10 between a first roll position A as illustrated at the lower end of FIG. 3 and an upper or second or feed roll position B indicated in phantom at the top of FIG. 3. Carriage 20 includes stationary end arms 22 that are secured together by a horizontal support structure 24 that extends across the width of support frame 10. A series of guide rollers 26 are secured to stationary arms 22 or other portions of movable carriage 20 and make contact with vertical surfaces of tubular frame elements 12 and 13 for proper guiding of carriage 20 therealong. A like group of rollers are located on opposite sides of columns 12 and 13 but are not shown. As illustrated in FIG. 1, a chain drive is provided for carriage 20. A chain 27 extends along the length of columns 12 and 13 (only shown on column 13) and passes about sprockets 28 and 29 at opposite ends of the column as illustrated for column 13. A motor 30 is connected via its output shaft to a reducer (not shown) and to a sprocket 31 which is connected to sprocket 29 (a double sprocket) by a short chain 38. Sprocket 29 on column 13 is interconnected with the upper sprocket (not shown) on column 12 by a torque tube 39 such that both chains are driven by motor 30. Chains 27 are clamped along one run to carriage 20 at plates 21 (only one shown adjacent column 13). Motor 30 then provides the driving force for movement of carriage 20 along support frame 10. Located within carriage 20 are a pair of movable arm assemblies generally 40 and 40′ which are mirror images of each other except as noted hereinafter. For the sake of brevity, only movable arm assembly 40 will be described in detail though it should be understood that except where noted movable arm assembly 40′ will be of like structure with like prime reference characters. Arm assembly 40 includes a housing defined by side plates 42 and end plates 43 which are appropriately secured as desired and from which depends a channel-shaped arm 44. As can be seen in particular in FIG. 2, appropriate rollers 45 are secured to side plates 42 and make guiding rolling contact with an inside surface of structural elements 25 located thereat, and which form a part of the horizontal support structure of movable carriage 20. Carriage 20 further has a support shaft 32 which is secured between stationary arm 22 and an intermediate vertical support element 33 which, in turn, is secured to elements 24 and 25 of carriage 20 and depends downwardly therefrom. As can be seen in FIG. 1, plates 43 include an opening 46 through which shaft 32 passes for supporting arm assembly 40 with appropriate bearing support (not shown) thereabout. Arm assembly 40 has a drive motor 50 for driving arm assembly 40 in and out with respect to a roll of goods. In other words, arm assemblies 40 and 40′ may be independently moved toward and away from each other by drive motors 50, 50′. As shown in FIGS. 2 and 6, the output shaft 51 of motor 50 is connected to a sprocket 52 which has a chain 54 extending therearound and with opposite ends of chain 54 being secured in an upper run at points 55 (see FIG. 4) to opposite end plates 43 of movable arm assembly 40. Chain 54 in its lower run passes through hollow shaft 32 and around an idler sprocket 56 that is located outwardly of stationary arms 22.

While movable arm assemblies 40 and 40′ may be independently controlled as noted above, once the arms have moved inwardly towards each other, are properly located with respect to a roll of goods to be handled, and the chuck means 70, 70′ brought into holding engagement with core C, the drive motors 50, 50′ for the two movable arm assemblies 40, 40′ are unitized so that the two arms can be moved simultaneously in either direction for centering or otherwise adjusting the position of the roll of goods held thereby for proper passage through the downstream process. Note for example in FIG. 6, where it is seen that drive shaft 51 of motor 50 is secured to drive sprocket 52 with drive chain 54 extending therearound. Drive sprocket 52 is connected to a further sprocket 60 which is interconnected with a pair of sprockets 62 and 63 by a chain 64. Sprocket 63 is, in turn, connected to yet a further sprocket 63′ associated with a movable arm assembly 40′ by a chain 66. In like fashion from movable arm assembly 40′, drive shaft 51′ of motor 50′ is connected to drive sprocket 52′ which, in turn, is connected to a further sprocket 60′ and through chain 64′ to sprocket 62′ and 63′. Sprockets 62′ and 63′ are thus not connected permitting independent movement of arm assemblies 40 and 40′. A clutch 67 is associated with sprocket 62′, however, which is actuated when arm assemblies 40 and 40′ come together and have properly chucked a roll of goods. When clutch 67 is actuated, sprockets 62′ and 63′ become joined to totally unite the two movable arms such that operation of either or both of drive motors 50 or 50′ will cause both movable arms to move in unison according to the direction of rotation of the motors such that a roll of goods held therebetween may be centered or otherwise manipulated for use in the process.

Figure 4:
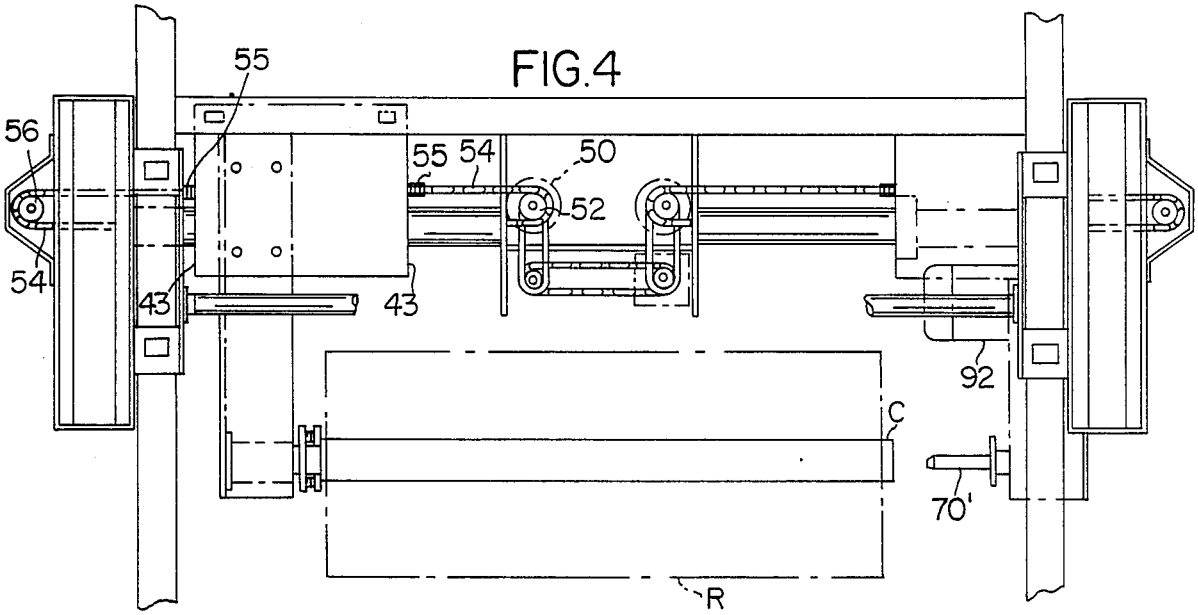
FIG. 4 is a rear elevational view of apparatus as shown in FIG. 1 illustrating a certain feature of same.

Referring to FIGS. 3 and 4, it can be seen that a driving arrangement is provided on arm assembly 40′ for imparting driving force to a roll R that is being unwound. Particularly, a motor 92 is secured to arm assembly 40′ with a sprocket 93 located on the output shaft of same. A further sprocket 94 is secured at chuck means 70′ and is connected to drive sprocket 93 by a timing belt 96. A positive driven unwind of roll R is thus facilitated. Moreover, the drive arrangement for roll R as described above could be located on either of the movable arm assemblies 40 or 40′.

Figure 5A:
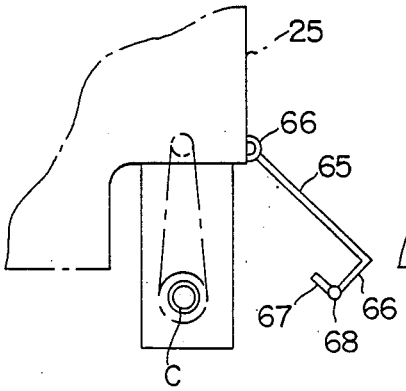
FIGS. 5*a*, 5*b* and 5*c* illustrate operation of core removal apparatus as shown in the present invention.
Figure 5B:
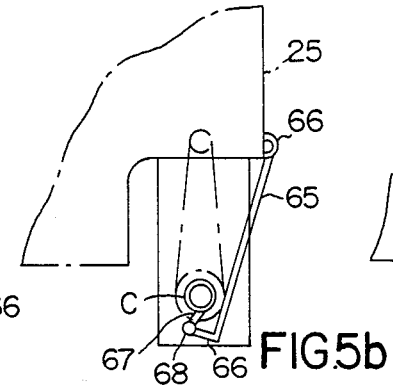
Figure 5C:
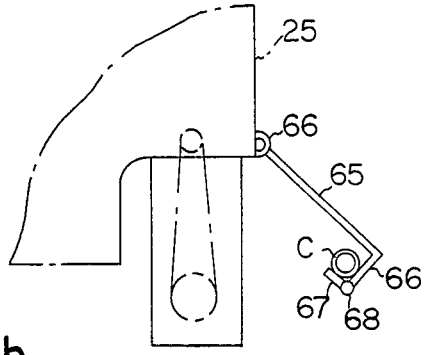

As can be seen in FIGS. 3, 5*a*, 5*b* and 5*c*, carriage 20 includes a core receiving element 65 which is pivotally secured to front wall 25 of carriage 20 at pivot point 66. As can be seen, core receiver 65 is in the shape of a J and includes a bottom leg 66 and a short upward leg 67 which is pivotally secured to bottom leg 66 at hinge 68. Referring specifically to FIGS. 5*a*, 5*b* and 5*c* it can be seen that when it is desirable to receive a core C from which a web of fabric or the like has been unwound, core receiver 65 moves inwardly and short front leg 67 engages core C which is still chucked between movable arm assemblies 40 and 40′. As core receiver 65 continues to move in the direction of core C, short leg 67 pivots rearwardly about hinge 68 until it passes core C, after which due to spring bias of hinge 68, short leg 67 returns to its original position with core C cradled therebehind for subsequently removal by an operator.

After depletion of the web from a core C, appropriate unchucking of core C from the respective movable arm assemblies is accomplished. With the core catcher 65 in place beneath core C, as both arms 40, 40′ move outwardly, according to one technique only one chuck, e.g. 70′ is deflated or otherwise deactuated while the opposite arm assembly, e.g. 40 remains appropriately chucked to core C. Such an arrangement is illustrated in FIG. 4 where the right-hand movable arm assembly 40′ is illustrated with deflated chuck 70′ retracted from core C, while arm 40 remains in a chucked position. Alternatively, both chucks 70, 70′ could be deflated with the arm assemblies moving outwardly. The stripper mechanisms would then hold the core until contact with same is lost, at which point the core would fall into the receiver.

Figure 7A:
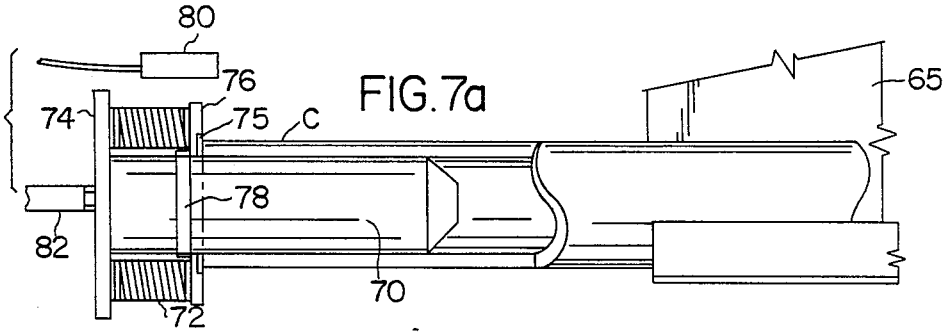
Figure 7B:
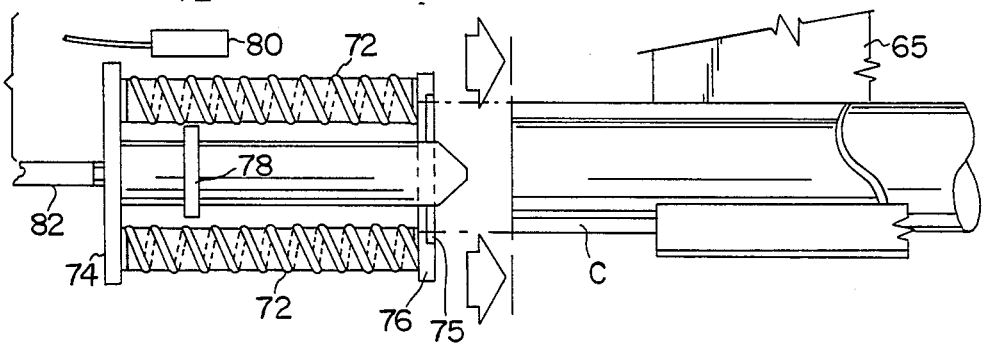

Referring now to FIGS. 7*a* and 7*b*, it can be seen that the chuck means 70 is inflated in FIG. 7*a* located within core C while to the left of same a stripper mechanism is provided to assist in removing core C from chuck 70 once chuck 70 is deflated or otherwise deactuated. As illustrated and is preferred, a plurality of individual springs 72, preferably three, are located between plates 74 and 76 that are associated with chuck 70. When a roll of goods is first chucked between arm assemblies 40 and 40′, movement of the arms 40, 40′ to insert chucks 70, 70′ within core C will cause compression of springs 72. Chucks 70, 70′ will engage a bearing 75 in the face of plate 76 for rotation therewith. In the area where plate 76 engages a flange 78 a proximity switch 80 or the like is located and is actuated which indicates that the chuck means from both movable arms are properly in position within the core C. A source of air is thus actuated which enters chucks 70, 70′ via conduits 82, 82′ (not shown) to inflate chucks 70, 70′ into holding position within core C. A rotary union as is known in the art (not shown) could be located to the rear of chuck 70 as illustrated in FIG. 7*a* to supply air to chuck 70.

In operation, a full roll R of fabric or the like is positioned on a cradle defined by a pair of rolls 15 that are rotatably supported on cantilevered supports 14. Carriage 20 which has been located in the upper or second roll position B descends towards roll R. With carriage 20 descending towards roll R, arm assemblies 40 and 40′ are in their open or extended position such that neither chuck means 70 nor 70′ would engage roll R. Preferably the method and apparatus according to the present invention are automatically operated, for example, by a programmable controller pc located within a control panel. Consequently, knowing the speed of descent of carriage 20 and the particular diameter of a roll to be handled, the programmable controller could determine a proper descent time for carriage 20 for reaching the proper vertical location of the chuck means with respect to core C and stop the carriage movement.

Alternatively, as shown in FIG. 3, a detector 90 may be employed on one or both movable arms 40, 40′ to sense the proper location for vertical alignment between chuck means 70, 70′ and core C. Again by way of example, a photocell receiver arrangement could be employed which could be operatively associated with the programmable controller pc such that in the downward movement of carriage 20, the photocell would detect first the presence of the outer edge of the roll of fabric or other goods R and after ceasing to see such fabric would be sensing the beginning of the core C. Thereafter, upon further downward movement once the fabric is seen again the system would know the distance of travel through the core and could locate the chuck at one-half the distance to properly center same with respect to the core. Obviously, likewise other techniques could be employed to properly vertically align chuck means 70, 70′ with opposite ends of core C. With the chuck means properly aligned, drive motors 50, 50′ are then actuated to move arm assemblies 40, 40′ inwardly where chucks 70, 70′ enter opposite ends of core C. Arm movement would continue until a stripper mechanism exemplified by springs 72 in FIGS. 7*a* and 7*b* is compressed adequately to actuate detector 80 at which point, an air source is actuated to inflate both chucks 70, 70′ as by way of conduit 82 with an appropriate conduit for chuck 70′ not being shown. Once the chucks 70, 70′ are inflated, a signal is generated to actuate the motor 30 (FIG. 1) which causes carriage 20 to move upwardly toward the second roll position B as illustrated in FIG. 3. Once fabric roll R is off the cradle rolls 15, motor 92 can be actuated whereby fabric starts feeding the process while carriage 20 continues to move upward to second position B. Once carriage 20 reaches the appropriate position, as verified by a limit switch or appropriate sensor mounted on column 13 (not shown), motor 30 is deactuated and the fabric or web of roll R continues to be fed into the process with which the present invention is being utilized.

As illustrated in FIG. 3, and as noted above, a portion of one suitable process with which the apparatus and method of the present invention may be combined is an automatic sewing system as has been described and claimed in commonly assigned application Ser. No. 107,176, filed Oct. 13, 1987. By way of example, if an automatic sewing system is added to the apparatus of the present invention or combined with it, then once the roll R is in the first position A as indicated as the lower position in FIG. 3, the lead end of the web from roll R would be manually arranged at a sewing table before being chucked or otherwise engaged by carriage 20 and while carriage 20 is in the up position feeding web from a roll R from the second roll position B. Upon depletion of the first roll, the tail end of the web will automatically be brought into proper alignment with the leading end of the new roll which is still then resting in the load position A and would be sewn together. Thereafter, Once the new roll R is secured to arms 40, 40′, upon raising of carriage 20 and thus new roll R, the web from the new roll R will automatically be fed into the particular process involved. While the present invention has been explained in conjunction with an automatic sewing operation, the automatic sewing operation does not form a part of the present invention and, in fact, any other arrangement could be employed in which the fabric or web could be unrolled from roll R after it leaves position A and while it resides in position B.

While a roll R is being unwound in the upper position B, an operator by whatever means can then properly position a new roll R in the load position A. The operator then prepares the new roll R for introduction to the particular process involved, such as the sewing operation described above. With the exception of placing of the new roll R onto the cradle defined by rolls 15 at the load or first position A, preparation of the lead end of the webs, and the removal of empty cores C from the core receiver 65, the remainder of the operation is preferably automatic, and most preferably is controlled by program controller pc. In such an arrangement, after the operator places the roll and positions the lead end of the web for sewing, he depresses an enable switch on the control panel and the remainder of the process proceeds automatically. Alternatively, with manual sewing or the like, obviously the operator would also perform same.

When roll R in second or upper position B becomes depleted, motor 92 is deactuated, clutch 67 is deactuated to separate arm assemblies 40, 40′, and drive motor 50′ of movable arm assembly 40′ is actuated to move arm assembly 40′ away from the core C after deflation of chuck 70′ (see FIG. 4). At the same time, arm assembly 40 with its chuck 70 still in proper holding engagement with core C moves to the left. When arm assembly 40 is fully to the left as would appear in FIG. 4, the apparatus for inflating chuck 70 (not shown) is deactuated which deflates chuck 70 as illustrated in FIG. 7*b* by, for example, venting air conduit 82 to the atmosphere. Once chuck 70 is deflated, it, of course, loses holding contact with the interior walls of core C which permits springs 72, to expand as shown in 7*b* with plate 76 forcing core C off of chuck 70. Core C then falls fully into the cradle formed by core receiver 65. Alternatively, both arm assemblies may be provided with stripper mechanisms and both unchuck and move away simultaneously as described above.

In a preferred embodiment, either unchucking operation of the core occurs as carriage 20 is moving downwardly from the second roll to the first roll position, and prior to reaching first roll position A. Obviously, after receiving an empty core C, core receiver 65 is returned to an out of the way position with respect to arm assemblies 40 and 40' as illustrated in FIGS. 3, 5a and 5c.

With apparatus according to the present invention in a fully automatic mode as described above, in conjunction with downstream apparatus, the only operations necessary for attendance by an operator are that of seeing that a new roll R is located on the cradle defined by rolls 15 in the first roll position while the carriage is in the second or run position, manual placement of the lead end of the web, and that empty cores maintained in core receiver 65 are removed. Otherwise, the operation is automatic, thus permitting the operator to attend further duties and/or reduce the labor requirement for the system.

It will be understood, of course, that while the form of the invention herein shown and described constitutes a preferred embodiment of the invention, it is not intended to illustrate all posible form of the invention. It will also be understood that the words used are words of description rather than of limitation and that various changes may be made without departing from the spirit and scope of the invention herein disclosed.

What is claimed is:

1. Apparatus for handling rolls of web goods for the subsequent unwinding of said comprising:

(a) a support frame;

(b) a carriage received on said support frame for vertical movement between first and second roll positions, said carriage having a pair of stationary spaced-apart arms secured thereto and extending outwardly therefrom, said carriage further having a pair of movable support arms associated with said stationary arms, each said movable support arm having roll chuck means associated therewith;

(c) independent drive means for said movable arms for moving said arms toward and away from each other; and (d) means for properly locating said chuck means with respect to an opening in the center of a roll of web located therebetween and actuating said chuck means when properly located with respect to said opening.

2. Apparatus as defined in claim 1 wherein said chuck means are inflatable and further comprising means for inflating said chuck means.

3. Apparatus as defined in claim 1 comprising further clutch means for interconnecting said drive means for said arms and means for actuating said clutch means when a roll is chucked by said arms whereby said arms can then move together.

4. Apparatus as defined in claim 1 wherein at least one of said movable arms has means at said chuck means thereon for automaticaly stripping an empty core therefrom.

5. Apparatus as defined in claim 1 wherein said carriage has means thereon for receiving an empty core after said chuck means have become disassociated therewith.

6. Apparatus as defined in claim 1 comprising further a program controller operatively associated with said elements, to determine proper vertical location of said chuck means with respect to said roll and to actuate said various drive means and said chuck means according to a predetermined sequence.

7. Apparatus for handling roll goods for subsequent unwinding of same comprising:

(a) a support frame;

(b) a carriage movable in a vertical direction along said support frame between first and second roll positions, said carriage having a pair of stationary, spaced apart arms secured thereto and extending outwardly therefrom, said carriage further having a pair of movable arms located within said stationary arms and being movable toward and away from each other, each said movable arm having roll chuck means secured thereto and extending toward the other of said movable arms;

(c) drive means for moving said carriage up and down along said support frame;

(d) means for locating the relative vertical position of said chuck means and a core about which said roll goods is produced, said locating means being operatively associated with said drive means to stop said carriage in proper alignment with said roll core to permit subsequent movement of said chuck means into said core;

(e) independent drive means for each of said movable arms for moving said arms toward and away from a roll of goods to be located therebetween;

(f) means for actuating said chuck means to move into holding engagement with said core; and (g) clutch means associated with said movable arm drive means to couple said drive means when a roll is chucked between said arms.

8. Apparatus as defined in claim 7 comprising further control means for automatically operating elements of said apparatus according to a predetermined sequence.

9. Apparatus as defined in claim 7 wherein said carriage further has means thereon for receiving an empty core after a roll has been unwound.

10. Apparatus as defined in claim 9 wherein at least one of said movable arms has means thereon for automatically stripping a core from the chuck means for said arm when said chuck means ceases holding engagement with said core.

11. Apparatus for handling roll goods for the subsequent unwinding of same comprising:

(a) a support frame;

(b) a carriage received on said support frame for vertical movement thereabout between a first, lower roll position and a second, upper roll position, said carriage having a pair of arms thereon movable towards and away from each other, each of said arms having roll chuck means thereon, one of said chuck means having core stripper means associated therewith, said carriage further having core receiving means thereon movable between a core receiving position and a non-receiving position;

(c) drive means for said carriage for moving said carriage vertically between said first and said second roll positions;

(d) independent drive means for each of said movable arms; and (e) means for uniting said movable arms for unitary movement after a roll of goods is chucked therebetween.

12. Apparatus as defined in claim 11 wherein said chuck means comprise inflatable chucks, and wherein said stripper means comprises at least one spring located about said one chuck, said at least one spring being compressed when said arms move into chucking engagement with said roll and expanding upon unchucking of said one chuck to force said core off of said chuck.

13. A method for handling rolls of web goods for the subsequent unwinding of same comprising the steps of:

(a) placing a roll of web goods at a first roll position;

(b) moving a pair of arms having chuck means thereon vertically to a position where said chuck means are in horizontal alignment for insertion into a core about which said roll of goods is wound;

(c) moving said arms independently towards said roll until said chuck means are properly received within said core;

(d) bringing said chuck means into holding engagement with said core;

(e) moving said arms and said roll vertically to a second roll position;

(f) feeding said goods to a process;

(g) removing at least one of said chuck means from holding engagement with said core, moving both of said arms outwardly, and stripping said core from said chuck means; and (h) returning said arms to said first roll position.

14. The method as defined in claim 13 wherein said arms with said chuck means thereon are automatically aligned with said core.

15. The method as defined in claim 13 wherein said chuck means are inflatable chucks and said chucks are inflated into holding engagement with said core.

16. The method as defined in claim 13 wherein said empty core is unchucked and stripped from said chucks during downward movement of said arms toward said first roll position and wherein a further roll of goods has been placed at said first roll position after said arms and said roll have moved upwardly to said second roll position.

17. The method as defined in claim 13 wherein the roll of goods is a roll of textile fabric.

18. The method as defined in claim 13 wherein prior to stripping said empty core from said chuck means, a core receiver is positioned therebeneath and after stripping said core from said chuck means, said core rests in said receiver and said receiver is moved away.

19. The method as defined in claim 13 further comprising the step of preparing the lead end of the web goods at the first position for subsequent feeding to a process prior to engagement of the roll by the chuck means.

20. The method as defined in claim 13 wherein feeding of the goods to the process begins before said roll of web goods reaches said second roll position.

21. The method as defined in claim 13 wherein one of said chucks is removed from holding engagement with said core before the other and said core is stripped from said other chuck when said other chuck is removed from holding engagement therewith.

* * * * *